US005765423A

United States Patent [19]

Cattaneo et al.

[11] Patent Number: 5,765,423

[45] Date of Patent: Jun. 16, 1998

[54] ROLLING UNIT FOR ROLLING ROD-SHAPED OR TUBULAR BODIES

[75] Inventors: Filippo Cattaneo; Roberto Brioschi, both of Milan; Maurizio Brignoli, Romano Di Lombardia; Ettore Cernuschi, Bareggio, all of Italy

[73] Assignee: Innse Innocenti Engineering S.p.A., Genova, Italy

[21] Appl. No.: 561,537

[22] Filed: Nov. 22, 1995

[30] Foreign Application Priority Data

Dec. 28, 1994 [IT] Italy ..... MI94A2661

[51] Int. Cl.[6] ..... B21B 13/10; B21B 13/08; B21B 31/00

[52] U.S. Cl. ..... 72/224; 72/237; 72/234

[58] Field of Search ..... 72/224, 234, 235, 72/238, 248, 239, 237

[56] References Cited

U.S. PATENT DOCUMENTS

| | | | |
|---|---|---|---|
| 1,899,659 | 2/1933 | Asbeck | 72/224 |
| 4,198,841 | 4/1980 | Vydrin et al. | 72/224 |
| 5,331,835 | 7/1994 | Palma et al. | 72/224 |

FOREIGN PATENT DOCUMENTS

| | | |
|---|---|---|
| 0 264 849 | 4/1988 | European Pat. Off. . |
| PCT/EP93/00898 | 4/1993 | European Pat. Off. . |
| 0 565 772 A1 | 10/1993 | European Pat. Off. . |
| 2 398 554 | 2/1979 | France . |
| MI92A0917 | 4/1992 | Italy . |
| MI9310704 | 4/1993 | Italy . |
| WO 93/20960 | 10/1993 | WIPO . |

*Primary Examiner*—Lowell A. Larson
*Assistant Examiner*—Rodney Butler
*Attorney, Agent, or Firm*—Lowe, Price, LeBlanc & Becker

[57] ABSTRACT

The inventive relates to a rolling unit (5) for rolling rod-shaped or tubular bodies, such as pipes, hollow sections bars, wires etc. The unit (5) is provided with three or more working rolls (20) which have respective rotation axes (A1, A2, A3) lying in a perpendicular plane to a rolling axis (L) along which the unit (5) is disposed. Advantageously, the rolls (20) are mounted on corresponding swinging arms arranged to oscillate in respective planes, perpendicular to the rotation axes (A1, A2, A3) of the corresponding rolls (20) and containing the rolling axis (L). Such a rolling unit can prevent any uncontrolled thermal expansions induced in the swinging arm by the high temperatures sometimes involved in the process, by keeping the rolls in a symmetrical position with respect to the plane of oscillation of the respective arm.

12 Claims, 5 Drawing Sheets

ROLLING UNIT FOR ROLLING ROD-SHAPED OR TUBULAR BODIES

DESCRIPTION

This invention relates to a rolling unit for rolling generic rod-shaped or tubular bodies, comprising an outer structure, at least three rolls journalled on respective swinging arms and whose rotation axis are substantially perpendicular to a rolling axis along which the unit is laid.

Rolling units as outlined above are already known in the iron, steel and other related industries for rolling tubular or rod-shaped bodies, the latter definition encompassing any finished and semi-finished products which have a major longitudinal dimension with respect to the others, such as pipes, bars, generic hollow sections, wires, etc..

Two recent examples of rolling units of this type, as well as of rolling mills incorporating them, are described in Italian Patent Applications MI92A000917 and MI93A000704 filed by this Applicant and presently laid open. In particular, these documents disclose a unit having a primary outer structure wherein a roll carrier of framed construction is mounted.

Advantageously, the latter can be pulled out of the structure, respectively in an axial or radial direction relative to the rolling axis, so that the rolls can be replaced by moving out the carrier. To this aim, the structure is provided with linear guides for the removal of the carrier which are laid axially or radially, according to the type of the unit structure, and with means for releasably locking the holders in their working position during the rolling process.

The working rolls are carried on respective swinging arms hinged on the carrier, which extend inwardly of the latter toward the rolling axis. The rotation axes of the rolls lie in a plane perpendicular to the rolling axis which is also the plane in which the swing arms oscillate to allow the spacing of the rolls from the rolling axis to be adjusted.

As explained in the above Italian Applications, the construction of the disclosed rolling unit allows the use of three or more driven rolls affording significant advantages in terms of processing quality, while retaining a high degree of flexibility throughout the production process by providing the possibility of independently setting the rolls position with respect to the rolling axis, even during operation. Furthermore, also the rolls replacement is made simpler to carry out, as is the rolling unit overall maintenance.

In accordance with the current trend to improve performances of such rolling units in order to expand their applicability, a demand exists for a solution to a problem which actually affects their operability and is connected with the prior art arrangements for mounting the rolls on the swinging arms.

In fact, the rolls of those rolling units have a shaped outer surface whose intersection with a plane radial to the rolls describes a substantially circular arc, commonly referred to as throat, having substantially the same length as the portion to be rolled of the workpiece, which length is inversely proportional to the number of rolls: that is, in the instance of a three-roll unit, approximately equal to ⅓ of the outer circumference of the workpiece to be rolled, likewise in the instance of a four-roll unit equal to ¼ and so on.

During operation of a rolling mill employing rolling units like those described above, possible uncontrolled thermal lengthwise expansions of the arms due to the high temperatures at which the process is sometimes carried out, cause movements of the rolls of a rolling unit from their nominal setting.

In this case, the positive results of this solution are partly reduced. Current rolling units are equipped with special adjustment devices arranged to act on the swinging arms which carry the rolls and to absorb the radial rolling forces; provision is also made for adjusting the position of the pins on which the arms are hinged.

The former devices allow for the adjustment to be made also during the rolling process, but cannot apply corrections exceeding a certain limit.

In fact, their operation produces a rotation of the arm about its pin (see FIG. 1); this rotation causes the roll to be moved from its nominal working conditions, that is a condition wherein of a median plane P of the roll perpendicular to the rotation axis thereof, passes through the rolling axis L (in FIG. 1, the intersection track of this plane with that of the drawing is vertical and is illustrated by a dot and dash line).

Consequently to this displacement, the profile of the roll throat will move to a position different from the nominal one, which is not symmetrical about the plane P above containing the rolling axis.

While for small oscillations of the swinging arms this may not be a problem, this effect must be compensated where adjustments on a wider range are involved.

This is done in practice by adjusting the position of the pins of the arm of each roll (see, for example, the direction of the arrow in FIG. 1), so that it is evident how the pin position setting has to be carried out each time, for instance, that the rolls are re-turned.

It is the invention object to provide a rolling unit having such constructional and operational features as to allow the rolls to be set in position without incurring the problems with which the aforementioned prior art is concerned.

This object is achieved, according to the invention, by a rolling unit as indicated in the preamble having the characterizing features set forth in the appended claims.

Further features and the advantages of the invention will more clearly result by an embodiment thereof described herein below by way of example and not of limitation with reference to the accompanying drawings, in which.

Figure 1:
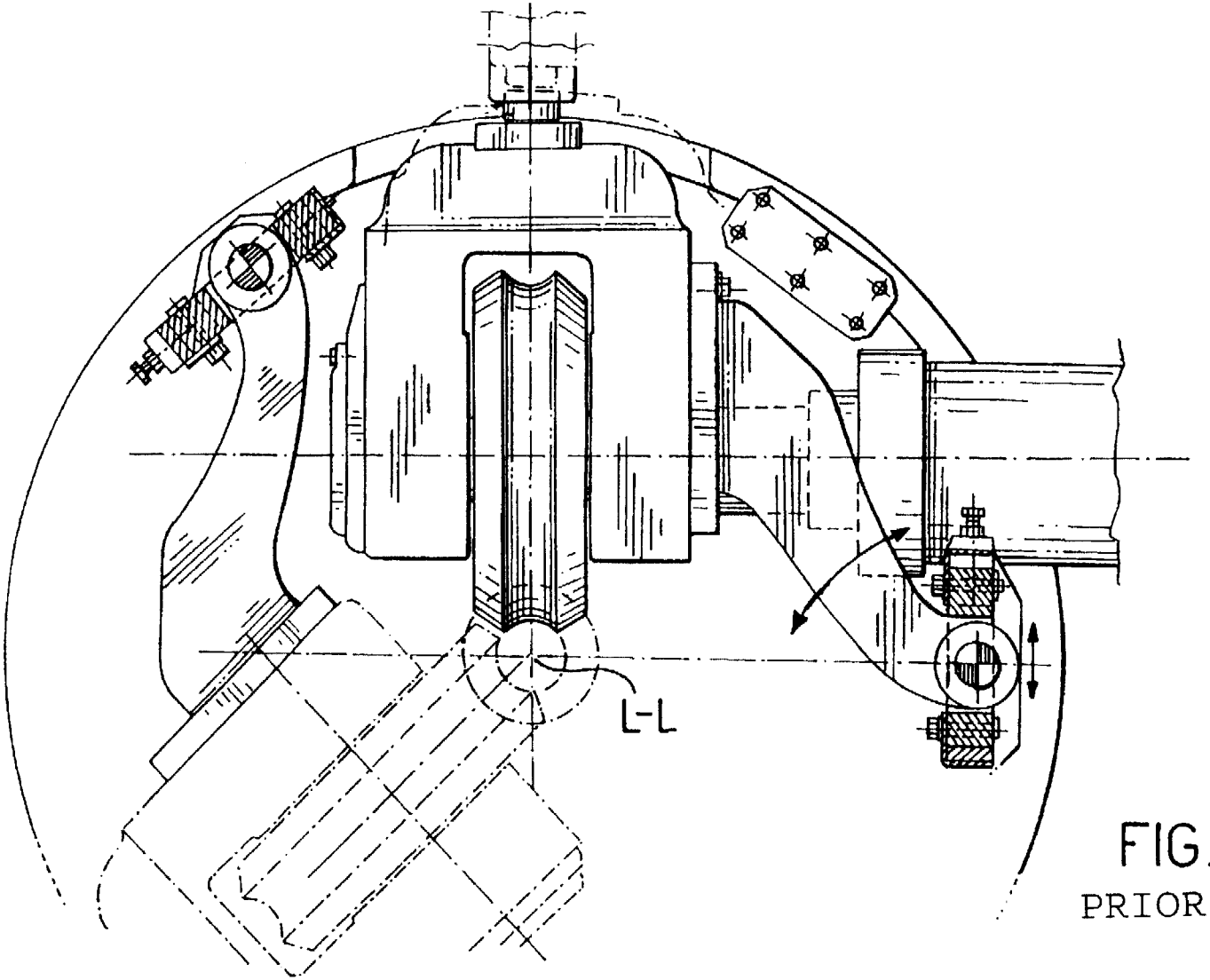
FIG.1 PRIOR ART
FIG. 1 is, as already referred to, a detail view of a prior art rolling unit.
Figure 2:
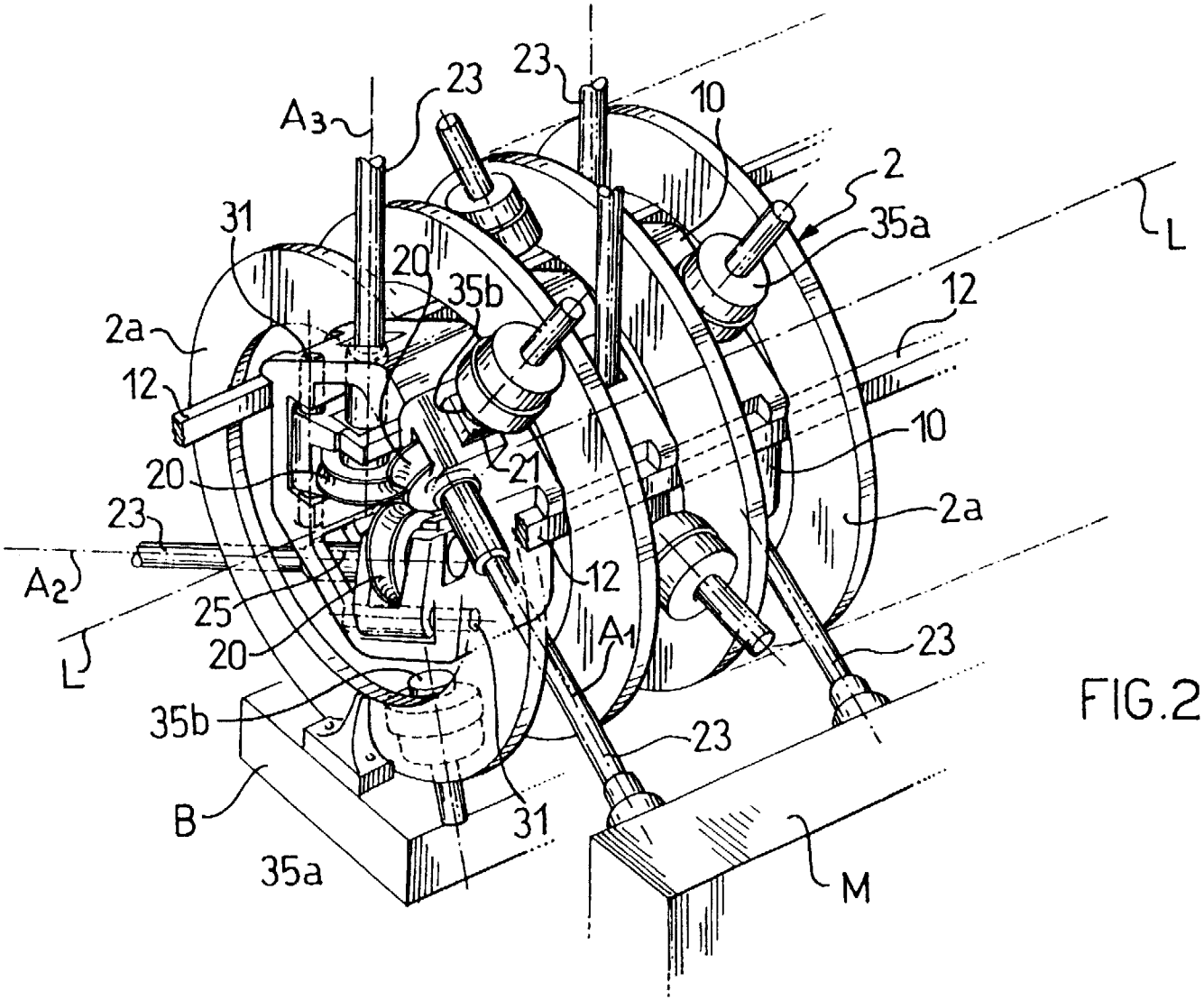
FIG. 2 is a perspective view of a rolling mill incorporating rolling units according to the invention.
Figure 3:
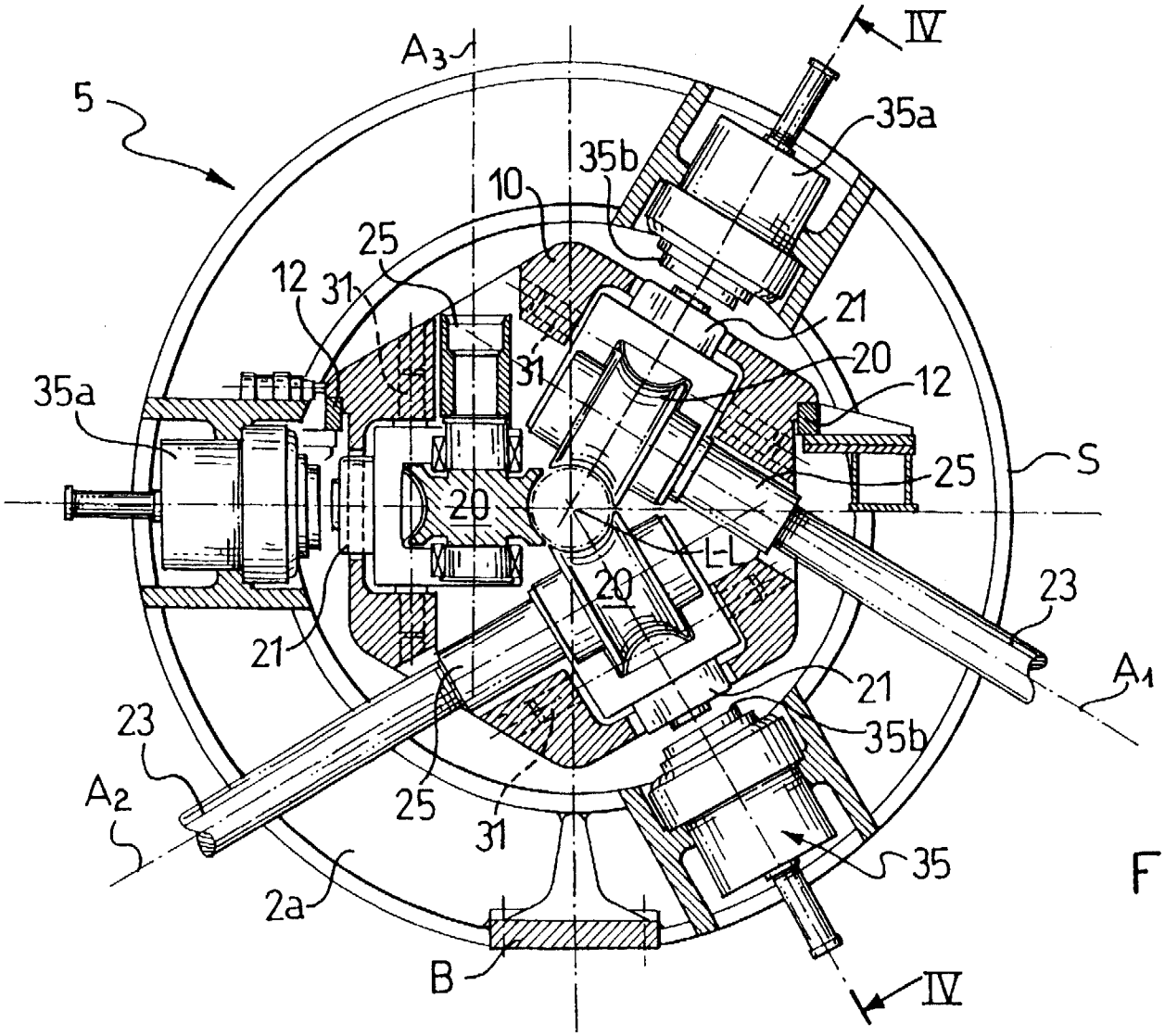
FIG. 3 is a part-sectional front view of a unit according to the invention.
Figure 4:
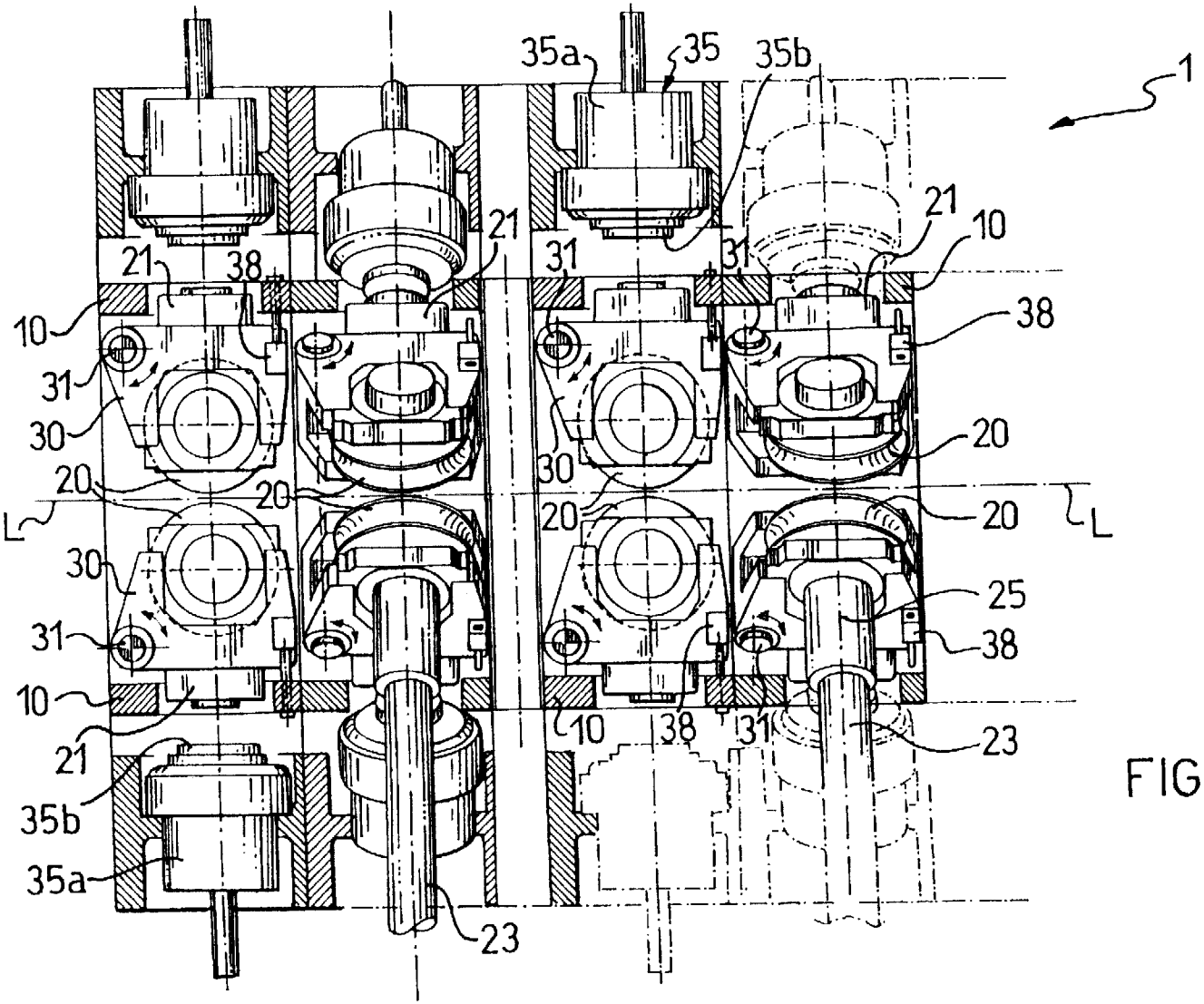
FIG. 4 is a sectional side view of the rolling mill of FIG. 2, taken along the line IV—IV in FIG. 3.

Referring to FIGS. 2 to 4, generally shown at 1 is a rolling mill according to the invention, which is of the type described in Italian Patent Applications MI92A000917 and MI93A000704 filed by this Applicant and presently laid open. Accordingly, only a general description of this rolling mill will be given herein, with special regard to those elements which distinguish it from what is specified in the above documents, while for further details, reference shall be made to the content of the specifications of the cited applications, hereto incorporated.

The rolling mill 1 comprises an outer structure 2 being laid along a rolling axis L and resting on a base B. The structure 2 of the rolling mill comprises a plurality of rigidly interconnected members 2*a* which are parts of respective structures S, joined continuously to one another, of rolling units 5 aligned along the rolling axis L to form the rolling mill 1.

Each rolling unit 5 includes two members 2*a* laid side-by-side in the primary structure 2 of the rolling mill, the members 2*a* forming its outer structure S which accommodates an enclosing roll carrier 10 on its interior consisting, in this example, of a hexagonal frame.

Specifically, the carrier 10 is supported slidably along the rolling axis L on a pair of guides 12 disposed within the structure S; it can be locked into an operative position inside the structure S and slid to a non-operative position outside the latter.

In the rolling mill, the carriers are packed into the structure 2, being borne on the guides 12 which extend lengthwise of the structure, and means, not shown in the drawings, are provided for the purpose of retaining them in that arrangement.

Mounted in the carrier 10 are three rolls 20, journalled on respective chocks 21, adapted to be driven rotatively about respective coplanar axes A1, A2 and A3 which lie in a perpendicular plane to the rolling axis L, by means of corresponding extensions 23 to be attached to respective connection shafts 25 of the rolls.

To this aim, the rolling unit 5 and the rolling mill 1 include, of course, drive means M for driving the extensions 23.

The chocks 21, in turn, are mounted on respective swinging arms 30 which are allowed to oscillate about a respective trunnion 31 located on the holder 10. Each swinging arm will pivot in a radial plane to the rolling axis L, that is in a perpendicular plane to the rotation axis A1, A2 or A3 of the corresponding roll which contains the rolling axis L.

Associated with each roll in the unit there is also a device 35 for adjusting the position of the roll relative to the rolling axis; such adjustment devices comprise a fixed part 35*a* rigidly connected to the members 2*a*, and a moving part 35*b* which reciprocates along a radial direction to the rolling axis and acts on the roll chocks 21.

These devices are known per se, and may be either oil or electrically operated; in the latter case, the moving and the fixed parts would jointly form a helical pair and therefore, further to the reciprocating motion mentioned above, the former is provided with a rotative motion about the aforementioned radial direction.

Furthermore, provided at each swinging arm of the rolling unit is a contrast means 38 effective to hold the rolls in an open position, that is away from the rolling axis, even when they are not acting on a workpiece to be rolled, to counteract the weight of each of them; in this example, this means consists of oil-operated cylinders.

The roll carrier are staggered along the rolling axis L of the rolling mill such that the sliding directions of the moving portions of the adjustment devices for each roll are, in the instance of a rolling unit having three rolls, rotated 60° from one rolling unit to the next, and in general rotated through an angle of 180°/n, where n is the number of rolls per rolling unit.

As to the way in which the rolling of rod-shaped or tubular body is carried out on a rolling mill according to the invention, this takes place gradually and accurately on account of at least the three driven rolls being provided for each rolling unit, with the other advantages that characterize rolling mills equipped with three or more driven rolls. Thus, the rod-shaped or tubular workpiece will be inserted directly or after being fitted over a mandrel, not shown in the drawings, from a feed-in end of the rolling mill and entrained to a feed-out end of the mill by the action of the rolls in the various rolling units.

But more important is the fact that the rolling unit of this invention does achieve its previously stated object.

In fact, it will be recognized from FIG. 4 that on the occurrence of longitudinal expansions of the swinging arms of each unit, no geometrical alterations would be induced as may affect the position of a roll 20 relative to the rolling axis L, because such expansions occur in a radial plane to the rolling axis L. This reflects favorably on production, in that a highly accurate rolling process can be obtained even when operating under conditions of uncontrolled thermal expansion.

Furthermore, it will be appreciated that the setting of the rolls in each rolling unit can be adjusted to accommodate variations in the shape of their throats, as may result from the periodical re-turning of the rolls. In fact, the pins on which the arms are hinged will require no positional adjustment on the carrier because it is sufficient that the arm of each roll be rotated to set the roll to a proper distance for re-positioning the roll throat relative to the rolling axis. On this circumstance, the contrast means can be used to advantage for setting the rolls to their desired positions.

A rolling unit according to the invention can offer a number of advantages.

For example, the layout of the swinging arms in radial planes to the rolling axis generally prevents the insurgence of roll asymmetries during the releasing and clamping movements from/to a workpiece or as a result of an increased or decreased distance of the roll rotation axis from the rolling axis; also, with the arms arranged as provided by the invention, it becomes possible to increase their radial shack on the pins to facilitate the assembly and disassembly of the swinging arm for the maintenance of the roll carrier.

Finally, it should be noted that, because of the oscillatory movements of the swinging arms occurring in radial planes, the rotation axis of each roll and the fixed axis located upstream of a drive extension will remain parallel to each other even while the arm is being moved.

Figure 5:
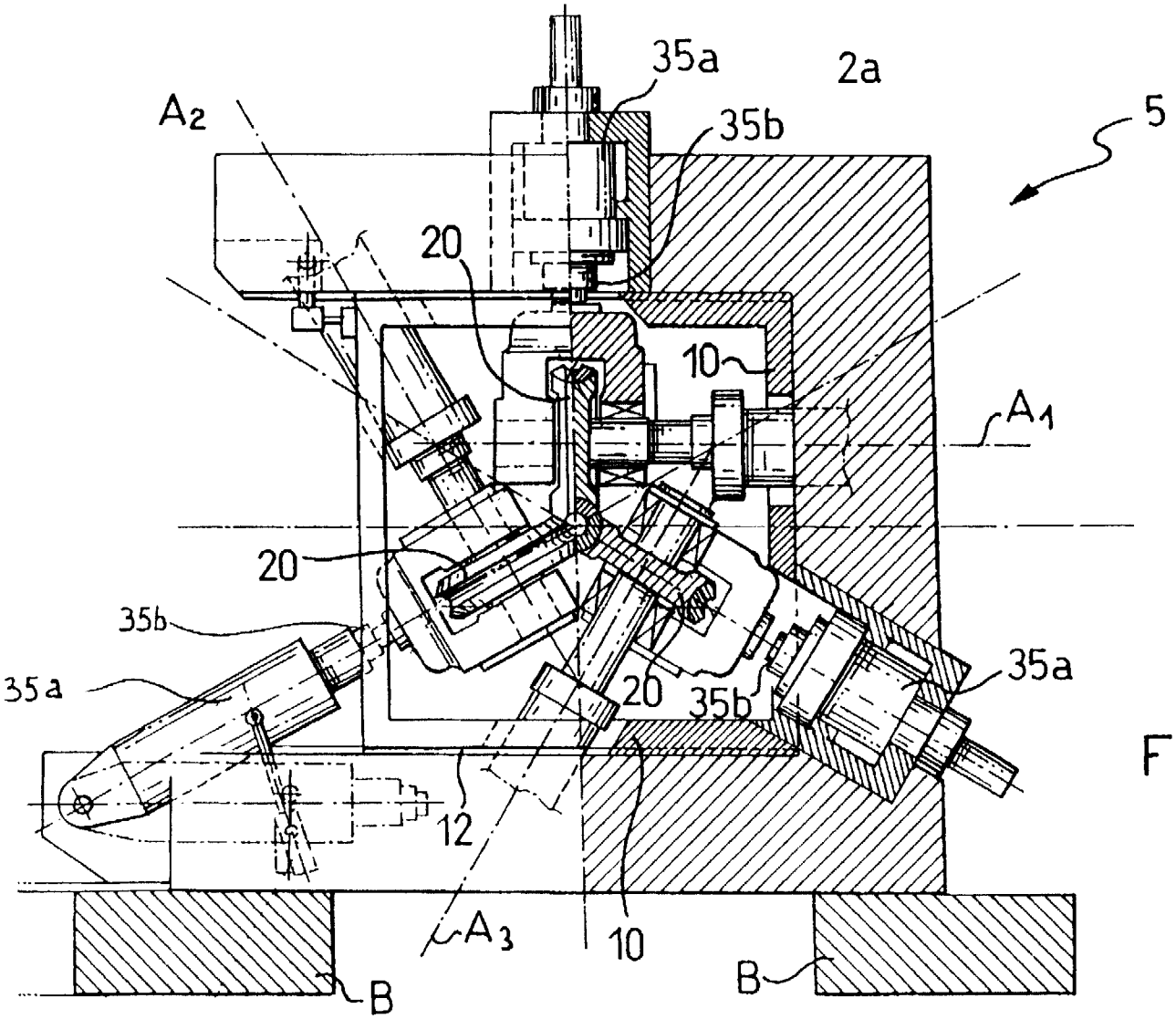
FIG. 5 is a part-sectional front view of an alternative embodiment of the rolling unit shown in FIG. 3.

In addition, the possibility should not be ruled out of making changes and modifications to the rolling unit of this invention. One of such possible variations is shown in FIG. 5, where a rolling unit is shown which has an outer structure S of the open type, that is one formed of members 2*a* which are generally C-shaped rather than being annular as in the previously discussed example. This embodiment also includes guides 12 along which the roll carrier 10 can be slid between an operative position where it is locked within the structure and a non-operative position for its removal. In general, those structural members which, as shown in FIG. 5, have the same functions in this modified embodiment as in the previous example, have been denoted by the same numerals. Here again, it will be appreciated that the layout of the swinging arms in radial planes to the rolling axis yields the same advantageous results as the previous example.

Finally, it should be understood that the arrangement of the rolls on the swinging arms in radial planes to the rolling axis could also be applied to rolling units wherein the arms and their rolls are not mounted in special carriers. In other words, this arrangements may be applied to rolling units, and hence rolling mills, other than those provided by the state of the art as previously discussed.

Lastly, it should be understood that the teaching of this invention may also be applied to rolling units equipped with more than three rolls. For example, it would not be too difficult to design a rolling unit with four rolls, rotatable about respective axes lying on opposite sides and carried by swinging arms which oscillate in respective planes perpendicularly to the rotation axes and containing the rolling axis.

Also, in this case, to make the construction of the rolling unit less complicated, a configuration could be provided wherein only one pair of opposite rolls be driven, and the other pair left freely rotatable. Here again, the swinging arms could be arranged to oscillate about a respective pin mounted on a carrier extractable from an outer structure, and adjustment devices could be associated with each roll and provided with a moving part active on the arm and a fixed part mounted to the structure, as previously described.

Finally, it will be appreciated that such rolling units may also be used to advantage with rolling mills wherein the rotation axes of the driven or freely rotatable roll pairs are staggered 90° from one unit to the next.

We claim:

1. A rolling unit for rod-shaped or tubular bodies, comprising an outer structure (S), at least three rolls (20) journalled on respective swinging arms (30) whose rotation axes (A1, A2, A3) lay substantially perpendicular to a rolling axis (L) along which the unit is laid, characterized in that each said swinging arm includes a pivot pin mounted to the outer structure so that said swinging arm is pivoted on an axis of said pivot pin and can be oscillated in respective planes substantially perpendicular to the rotation axes of the corresponding rolls and containing said rolling axis, and an adjustment device (35) is associated with each swinging arm (30), said adjustment device including a fixed part (35*a*) connected to the outer structure (S) of the unit and a moving part (35*b*) arranged to move along a radial direction to the rolling axis (L) and to act on the corresponding arm.

2. A rolling unit according to claim 1, characterized in that at least two of said rolls (20) are driven rolls.

3. A rolling unit according to claim 1, characterized in that said swinging arms (30) are pivotally mounted in a roll carrier (10) which is slidable in a guided manner between an operative position occupied during the rolling process and where it is locked within said structure (S) and a non-operative position outside said structure.

4. A rolling unit according to claim 1, characterized in that said outer structure (S) is substantially cylindrical in shape and coaxial with the rolling axis.

5. A rolling mill for rolling rod-shaped or tubular bodies, characterized in that it comprises a plurality of rolling units as claimed in claim 1 laid side-by-side along the rolling axis (L) between a feed-in end and a feed-out end for said rod-shaped or tubular bodies.

6. A rolling mill according to claim 1 further comprising a means for keeping the rolls away from the rolling axis.

7. A rolling mill according to claim 1 wherein the outer structure is a roller carrier and each said swinging arm is pivotally mounted to the roll carrier.

8. A rolling unit according to claim 3, characterized in that said outer structure (S) is substantially C-shaped and open sideways to permit the sliding movement of said roll carrier (10).

9. A rolling mill according to claim 5, characterized in that the outer structures of the side-by-side rolling units are interconnected rigidly to form a primary outer structure (2) of the rolling mill.

10. A rolling mill according to claim 5 characterized in that the roll carriers (10) of the rolling units are identical with one another, and that the rolls of one unit and those of an adjacent unit in the rolling mill are staggered, the staggered layout being obtained by turning upside-down the carrier about an overturn axis which intersects the rolling axis (L) and extends parallel to one of the roll (20) axes (A1,A2,A3).

11. A rolling mill according to claim 10, characterized in that each roll carrier (10) carries three rolls having respective rotation axes (A1,A2,A3) which intersect one another at an angle of 60° when lying in the same plane.

12. A rolling mill according to claim 6 wherein the roller carrier has a recess to receive each swinging arm, opposing walls of said recess receiving ends of the pivot pin for said pivotal mounting.

* * * * *